US005934868A

United States Patent [19]

Bättig et al.

[11] Patent Number: 5,934,868

[45] Date of Patent: Aug. 10, 1999

[54] AXIAL TURBINE OF AN EXHAUST-GAS TURBOCHARGER

[75] Inventors: Josef Bättig, Egliswil, Switzerland; Rudolf Ricanek, Weilheim, Germany

[73] Assignee: Asea Brown Boveri AG, Baden, Switzerland

[21] Appl. No.: 08/834,284

[22] Filed: Apr. 15, 1997

[30] Foreign Application Priority Data

May 8, 1996 [DE] Germany ..... 196 18 313

[51] Int. Cl.[6] ..... F01D 21/00

[52] U.S. Cl. ..... 415/9; 415/214.1; 415/220

[58] Field of Search ..... 415/9, 220, 222, 415/214.1, 204, 206

[56] References Cited

U.S. PATENT DOCUMENTS

| | | | |
|---|---|---|---|
| 3,928,963 | 12/1975 | Devers et al. | 415/178 |
| 4,184,812 | 1/1980 | Nomura et al. | 415/214.1 |
| 4,648,790 | 3/1987 | Horler | 415/112 |
| 4,902,201 | 2/1990 | Neubert | 415/197 |

FOREIGN PATENT DOCUMENTS

| | | |
|---|---|---|
| 0118051 | 9/1984 | European Pat. Off. . |
| 928746 | 6/1955 | Germany . |
| 1036581 | 8/1958 | Germany . |
| 2376217 | 6/1976 | Germany . |
| 3302576A1 | 8/1983 | Germany . |
| 4223496A1 | 1/1994 | Germany . |

OTHER PUBLICATIONS

"Turbolader hoher spezifischer Leistung–eine Forderung moderner Dieselmotoren", Appel, et al., MTZ Motortechnische Zeitschrift 54 (1993), p. 288.

"NA–type turbochargers with axial flow turbines", Man B&W product literature.

*Primary Examiner*—F. Daniel Lopez
*Assistant Examiner*—Richard Woo
*Attorney, Agent, or Firm*—Burns, Doane, Swecker & Mathis, L.L.P.

[57] ABSTRACT

The object of the invention is to provide simple and cost-effective, internal rupture protection for the axial turbine of an exhaust-gas turbocharger. At the same time, the functional reliability of the exhaust-gas turbocharger is to be increased. According to the invention, this is achieved in that the rupture-protection ring (8) is designed as an integral, essentially radially extending, part of the gas-inlet-side wall (5) of the gas-outlet casing (2) and is connected to the gas-inlet casing (1) either directly or via an axial extension piece (6) arranged upstream.

10 Claims, 3 Drawing Sheets

AXIAL TURBINE OF AN EXHAUST-GAS TURBOCHARGER

BACKGROUND OF THE INVENTION

1. Field of the Invention

The invention relates to an axial turbine of an exhaust-gas turbocharger connected to an internal combustion engine according.

2. Discussion of Background

A decisive criterion for increasing the output of internal combustion engines connected to exhaust-gas turbochargers is the boost pressure applied by the compressor of the exhaust-gas turbocharger. If the boost pressure is increased, more air can be forced into the cylinders and the output of the internal combustion engine can thus be improved. In order to achieve high boost pressures, the exhaust-gas turbochargers used today rotate at very high circumferential velocities. The result of this, in particular in the case of relatively large exhaust-gas turbochargers, is that the fragments of a ruptured moving blade can only be retained in the turbine casing by elaborate design measures. As a result of the relatively large mass of the possible fragments, this problem is further increased in the so-called integral turbines, since their turbine disks and moving blades are made in one piece.

In the known exhaust-gas turbochargers having an axial turbine, the turbine disk is disposed axially in the gas-outlet casing and its moving blades are bounded radially to the outside by a cover ring/diffuser. In the extreme case, the turbine disk of the axial turbine is arranged in the middle of the gas-outlet casing (see article by M. Appel et al. on the subject "Turbolader hoher spezifischer Leistung . . . " [Turbochargers of high specific output . . . ], in MTZ 54(1993)6, FIG. page 288). Since in this solution the outer wall of the gas-outlet casing or the flue follows directly after the thin cover ring/diffuser in the radial direction, virtually no resistance is offered to the fragments thrown outward at high speed if a moving blade or the turbine disk ruptures. Therefore the outer wall of the turbocharger may be pierced and thus persons may be endangered or adjacent machine parts damaged.

In order to prevent this, the exhaust-gas turbochargers are often provided with external rupture protection. However, such cladding attached to the outer wall of the axial turbine is very elaborate and thus expensive. DE-A1-42 23 496 also discloses internal rupture protection for an axial turbine. To this end, a protective ring extending axially in the region of the turbine disk is fastened to the turbine casing. This protective ring is arranged radially between the casing wall and the turbine disk at a slight distance from its rotational plane. However, apart from the assembly effort, such a separate rupture ring also requires additional production costs, which in turn increases the overall costs of the exhaust-gas turbocharger.

In addition, the MAN B&W NA turbocharger series (company brochure D366002/2E "NA-type turbochargers with axial-flow turbines", page 5, FIG. 4) discloses a rupture-protection ring designed as an integral, essentially radially extending, part of the gas-inlet-side wall of the gas-outlet casing. Said rupture-protection ring is connected to both the gas-inlet casing and the gas-outlet casing via an axial extension piece arranged downstream. To this end, a complicated, i.e. elaborate, connection between the extension piece and the gas-inlet casing is realized by means of relatively long flanges. However, such connecting elements arranged in direct proximity to the hot exhaust gases of the internal combustion engine which flow through the turbine are subjected to high thermal stresses and are therefore at great risk of breaking off. As a result, the functional reliability of such an exhaust-gas turbocharger may be put at risk and its service life reduced.

SUMMARY OF THE INVENTION

Accordingly, one object of the invention, in attempting to avoid all these disadvantages, is to provide simple and cost-effective, internal rupture protection for the axial turbine of an exhaust-gas turbocharger. At the same time, the functional reliability of the exhaust-gas turbocharger is to be increased.

According to the invention, this is achieved in that, in a device according to the preamble of claim 1, the rupture-protection ring is designed as an integral, essentially radially extending, part of the gas-inlet, facing side wall of the gas-outlet casing. To this end, the rupture-protection ring is connected to the gas-inlet casing either directly or via an axial extension piece arranged upstream.

As a result of this design, the side wall of the gas-outlet casing performs the function of the rupture protection for the turbine disk. Therefore no separate component is required for this purpose, which saves both costs and assembly time. In addition, the connection between the rupture-protection ring and the gas-inlet casing can be kept very short and compact, i.e. it can be realized in a simple and stress-optimized manner. This reduces the costs of the exhaust-gas turbocharger and increases its functional reliability.

In a first embodiment of the invention, the side wall comprises at least the axial extension piece adjoining the gas-inlet casing, a gas-outlet connection extending mainly radially thereto, and the rupture-protection ring. The latter connects the extension piece to the gas-outlet connection.

The side wall of the gas-outlet casing, which wall is of a three-piece design, advantageously permits both a relatively short axial turbine and a relatively simple gas-inlet casing.

It is especially expedient if the rupture-protection ring has an axial length and a radial height which correspond at least approximately to the width and, respectively, at least approximately half the height of a moving blade. The rupture-protection ring arranged to rotate in the outer region of the turbine disk is thus of a relatively solid design. In the event of an accident, the fragments of the ruptured moving blade strike the rupture-protection ring arranged axially in its region and thereby release most of their kinetic energy to this rupture-protection ring. In this way, piercing of the outer wall of the turbocharger and therefore endangering of persons or damage to adjacent machine parts can be prevented.

In an especially advantageous manner, the rupture-protection ring has an axial length and a radial height which correspond approximately to the width and height, respectively, of a moving blade. The thus enlarged rupture-protection ring has an improved protective effect. It can therefore catch not only the fragments of ruptured moving blades but also the fragments of the turbine disk. Each further increase in the axial length or the radial height of the rupture-protection ring results in increased safety in the event of accidents.

The gas-outlet connection is widened conically radially outward relative to the rupture-protection ring, as a result of which a uniformly enlarged cross section of flow is obtained. The gas-outlet connection therefore acts as a diffuser, which leads to an improved turbine efficiency.

As an alternative to the first embodiment of the invention, the gas-inlet-side wall of the gas-outlet casing may comprise only the axial extension piece and the rupture-protection ring, the latter being arranged downstream of the extension piece. Finally, the side wall of the gas-outlet casing may also be formed by the rupture-protection ring and a mainly radially extending gas-outlet connection. This leads to a considerably simplified design of the gas-outlet casing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing of the axial turbine of an exhaust-gas turbocharger, wherein.

Only the elements essential for understanding the invention are shown. Elements of the unit which are not shown are, for example, the compressor side of the exhaust-gas turbocharger. The direction of flow of the working medium is designated by arrows.

DESCRIPTION OF THE PREFERRED EMBODIMENTS

Figure 1:
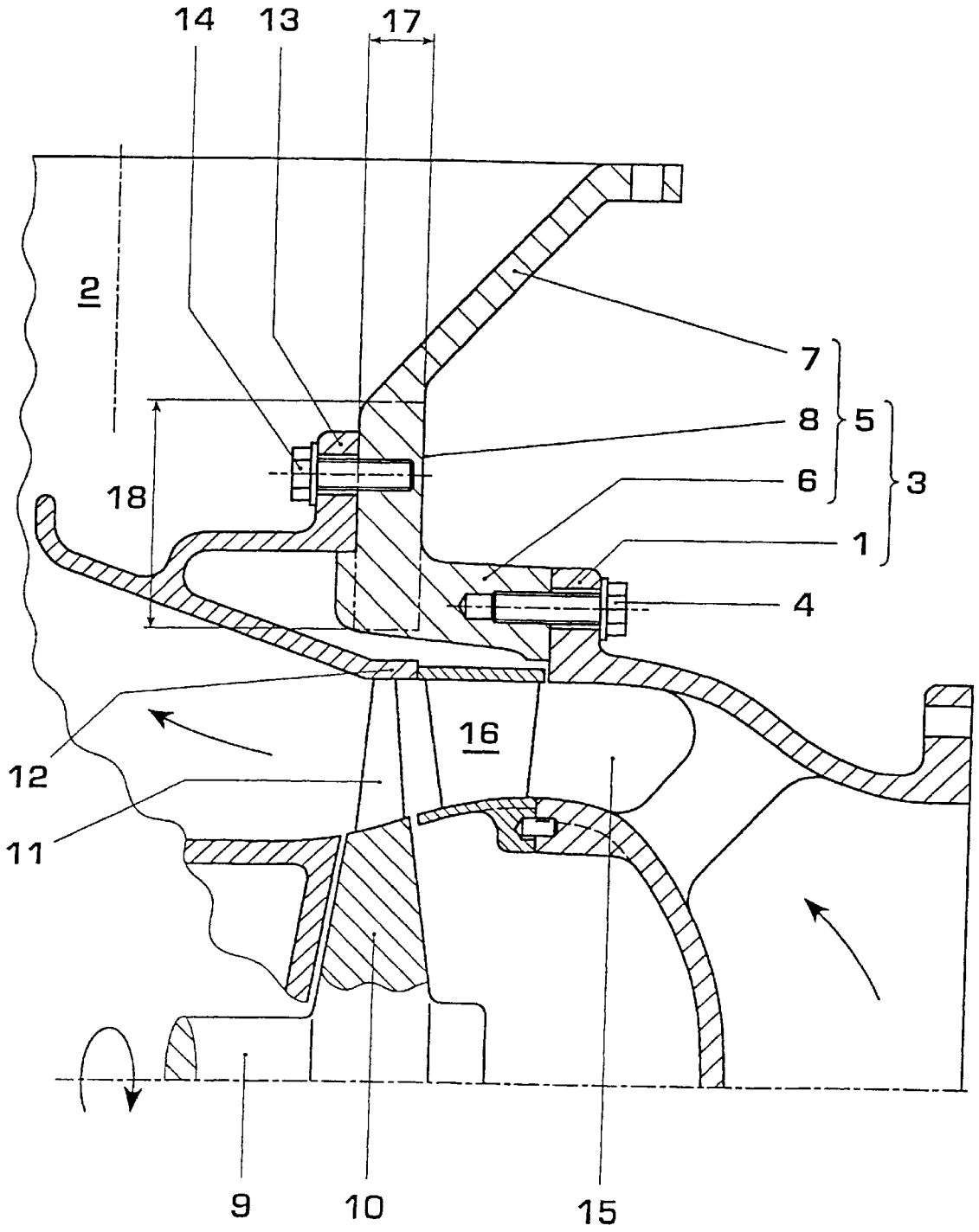
FIG. 1 shows a partial longitudinal section of the exhaust-gas turbocharger in the region of the axial turbine.

Referring now to the drawings, wherein like reference numerals designate identical or corresponding parts throughout the several views, the axial turbine of a turbocharger has a turbine casing 3 which is formed by a gas-inlet 1 and a gas-outlet casing 2 and is held together by means of connecting elements 4 designed as screws. The gas-outlet casing 2 has a gas-inlet-facing wall 5 and a compressor-side wall, the latter not being shown. The side wall 5 is of a three part design. It comprises an axial extension piece 6 adjoining the gas-inlet casing 1, a gas-outlet connection 7 extending mainly radially to the extension piece 6, and also a rupture-protection ring 8. The extension piece 6 and the gas-outlet connection 7 are connected to one another via the rupture-protection ring 8. The gas-outlet connection 7 is widened conically radially outward relative to the rupture-protection ring 8 (FIG. 1).

A turbine disk 10, carried by a shaft 9 and having moving blades 11, is arranged in the turbine casing 3. The turbine disk 10 is bounded to the outside by a cover ring 12 which is designed as a diffuser and is in turn fastened via a flange 13 and by means of screws 14 to the side wall 5 of the gas-outlet casing 2, or to the rupture-protection ring 8. A flow passage 15 is formed between the turbine disk 10 and the turbine casing 3, which flow passage 15 receives the exhaust gases from a diesel engine (not shown) connected to the turbocharger and passes them on to the moving blades 11 of the turbine disk 10. A different internal combustion engine may of course also be connected to the turbocharger. A nozzle ring 16 is arranged in the flow passage 15 upstream of the moving blades 11 and is restrained axially between the cover ring 12 and the gas-inlet casing 1.

The rupture-protection ring 8, designed as an integral part of the side wall 5 of the gas-outlet casing 2, extends axially in the region of the turbine disk 10 and is arranged at a slight radial distance from the rotational plane of its moving blades 11. It has an axial length 17 and a radial height 18 which are greater than the width and the height, respectively, of the moving blades 11.

If a moving blade 11 fractures during the operation of the exhaust-gas turbocharger, its fragments are thrown against the rupture-protection ring 8. The latter absorbs most of their kinetic energy. On account of its solid design, the rupture-protection ring 8 undergoes only slight deformations in the process, so that the gas-outlet casing 2 does not have to be exchanged. If a rupture-protection ring 8 enlarged in its radial height 18 is used, even fragments of the rupturing turbine disk 10 can be caught without endangering persons or surrounding machine parts.

On account of the radially outward conical widening of the gas-outlet connection 7 relative to the rupture-protection ring 8, a correspondingly enlarged cross section of flow is obtained for the exhaust gases, expanded in the axial turbine, from the diesel engine connected to the turbocharger. The gas-outlet connection 7 thereby acts as a diffuser, which leads to an improved turbine efficiency.

Figure 2:
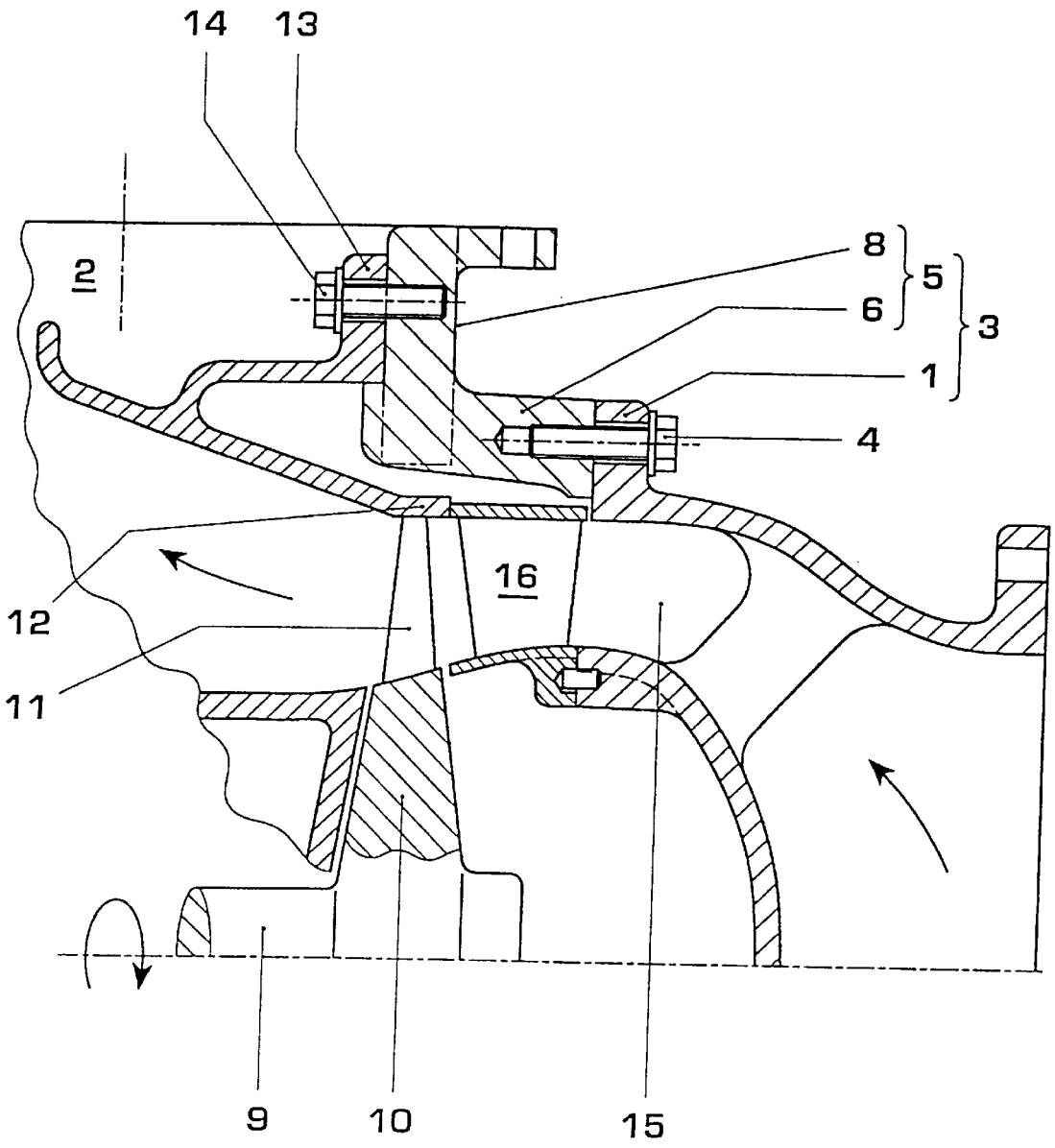
FIG. 2 shows a representation corresponding to FIG. 1 but in a second exemplary embodiment.
Figure 3:
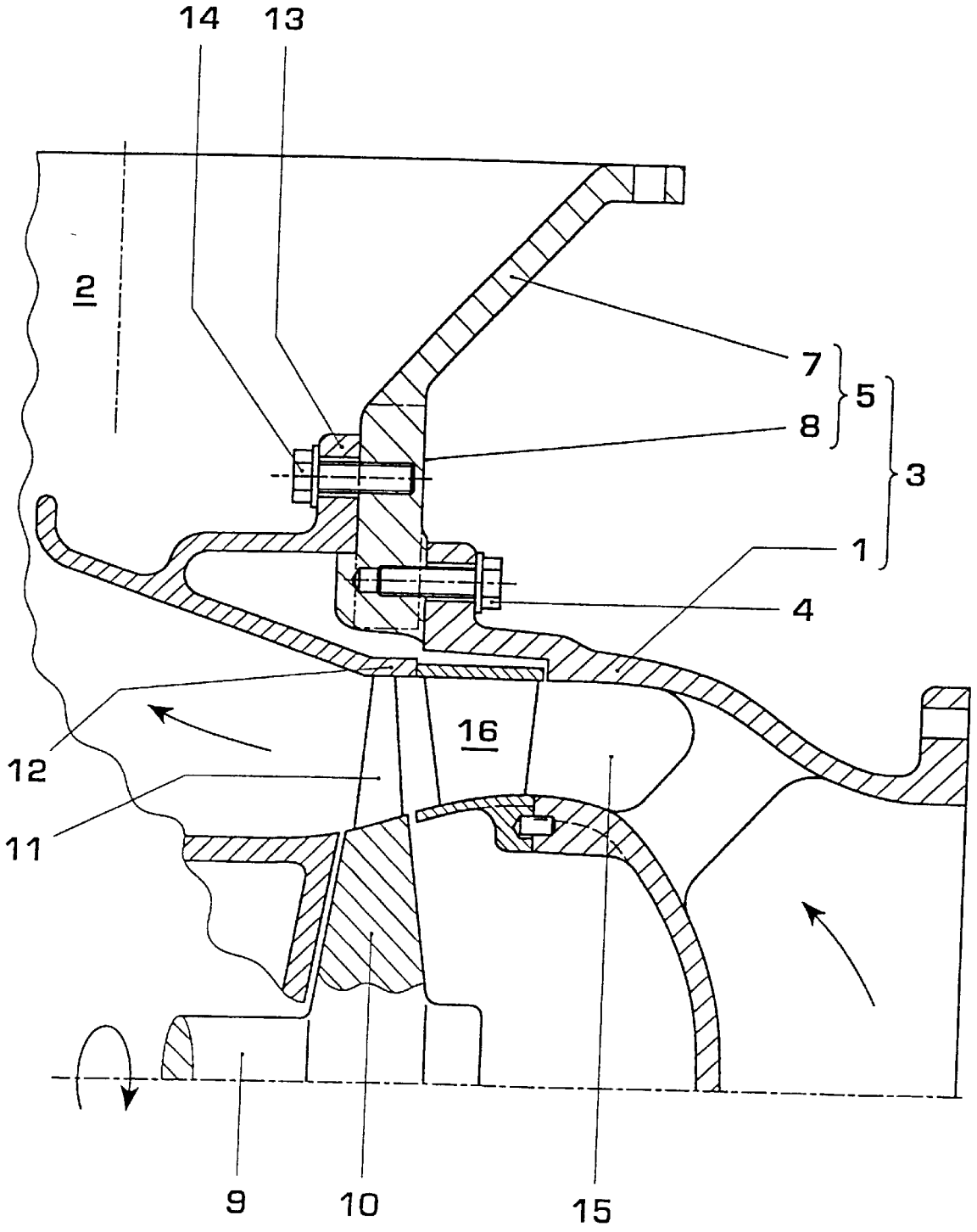
FIG. 3 shows a representation corresponding to FIG. 1 but in a third exemplary embodiment.

In a second and third exemplary embodiment, the side wall 5 of the gas-outlet casing 2 is simplified, i.e. it is only of a two-piece design. To this-end, either no gas-outlet connection 7 (FIG. 2) or no extension piece 6 (FIG. 3) is formed, the gas-inlet casing 1 being correspondingly extended in the latter case. The function of both solutions is essentially analogous to the first exemplary embodiment. A one-piece side wall 5 of the gas-outlet casing 2 may of course also be realized (not shown) by dispersing with both the gas-outlet connection 7 and the extension piece 6.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An axial turbine of an exhaust-gas turbocharger, comprising a gas-inlet casing, a gas-outlet casing having a side wall connected to the gas-inlet casing, a rotatable turbine disk having a plurality of blades, and a cover ring disposed radially about the outside of the blades, wherein the cover ring is removably secured to the side wall of the gas-outlet casing, wherein the side wall is formed as a unitary part including a radially extending portion disposed radially outside the blades at a slight radial distance from a rotational plane of the blades and in an axial region with the turbine disk, wherein the radially extending portion forms a rupture-protection ring surrounding the turbine disk.

2. The axial turbine as claimed in claim 1, wherein the side wall further comprises an axial extension portion extending axially from one end of the rupture protection ring and a gas-outlet connection extending mainly radially from a second end of the rupture protection ring.

3. The axial turbine as claimed in claim 2, wherein the gas-outlet connection widens conically radially outward relative to the rupture-protection ring.

4. The axial turbine as claimed in claim 2, wherein the rupture-protection ring has an axial length and a radial height which correspond respectively, to at least approximately width of the blade and, at least approximately half a height of a the blade.

5. The axial turbine as claimed in claim 4, wherein the axial length and the radial height of the rupture-protection ring correspond approximately to the width and height, respectively, of the blade.

6. The axial turbine as claimed in claim 4, wherein the axial length and radial height of the rupture-protection ring are greater than the width and height, respectively, of the blade.

7. The axial turbine as claimed in claim 1, wherein the side wall of the gas-outlet casing comprises an axial extension portion extending axially from one end of the rupture-protection ring and a mainly radially extending gas-outlet connection extending from a second end of the rupture protection ring.

8. The axial turbine as claimed in claim 1, wherein the side wall further comprises an axial extension portion extending from the rupture protection ring, the side wall being fastened to the gas-inlet casing by the axial extension portion.

9. The axial turbine as claimed in claim 8, wherein the side of the gas-outlet casing comprises at least the axial extension portion and the rupture-protection ring, the rupture protection ring being arranged downstream of the extension piece.

10. The axial turbine as claimed in claim 1, wherein the side wall is fastened to the gas-inlet casing by the rupture protection ring.

* * * * *